United States Patent [19]

Haines

[11] 3,981,953

[45] Sept. 21, 1976

[54] METHOD FOR CASTING BLOCKS HAVING FRACTURED FACE

[76] Inventor: Donald John Haines, 12 Judges Close, Hereford, England

[22] Filed: Mar. 19, 1974

[21] Appl. No.: 452,661

[30] Foreign Application Priority Data

July 4, 1973 United Kingdom ..... 16801/73
July 20, 1973 United Kingdom ..... 34698/73

[52] U.S. Cl. ..... 264/163; 264/71; 264/293; 264/297; 264/333; 264/336; 425/DIG. 109

[51] Int. Cl.[2] ..... B28B 3/02

[58] Field of Search ..... 264/71, 72, 138, 139, 264/163, 293, 333, 336, 297; 425/DIG. 109, 406, 412

[56] References Cited

UNITED STATES PATENTS

| | | | |
|---|---|---|---|
| 433,785 | 8/1890 | Harding | 264/293 X |
| 1,376,321 | 4/1921 | Crozier | 264/293 X |
| 1,523,710 | 1/1925 | Pfeiffer | 425/DIG. 109 |

*Primary Examiner*—Robert F. White
*Assistant Examiner*—Thomas P. Pavelko
*Attorney, Agent, or Firm*—Finnegan, Henderson, Farabow & Garrett

[57] ABSTRACT

A method of casting concrete blocks having a fractured face. A pattern or frame is embedded in a mass of concrete within a mold and after the mass is compacted within the mold and about the frame, the frame is moved relative to the compacted mass so as to randomly fracture the concrete mass between the elements of the frame. The frame together with a portion of the fractured mass are removed from the finished block.

4 Claims, 5 Drawing Figures

METHOD FOR CASTING BLOCKS HAVING FRACTURED FACE

This invention relates to the production of building elements such for example as wall blocks, tiles, pavings, decorative panels etc. and also to items which are assembled together to form a unit such for instance as fireplaces.

It is known in the production of wall blocks to use a semi-dry mix of the material forming the block and to place the material in a mould box after which it is pressed with a die to achieve compaction of the material. The resulting block after curing, has a surface hereinafter referred to as the front surface, which has the same surface pattern as the die. Moreover, each block produced using the same die has an identical surface pattern on the front face.

It is an object of the present invention to provide a method and apparatus for producing building elements having a random split appearance on the front surface.

It is a further object to provide on the front surface recessed lines of a predetermined pattern.

A method in accordance with the invention comprises filling a mould box with a semi-dry mix of the material from which the building element is to be formed, incorporating in the material a frame including a number of elements, compacting the mass of material with the frame in position and moving the frame relative to the compacted mass so as to fracture the compacted mass along a plane including the elements of said frame, the fractured surface of the resulting building element having a random split appearance.

Apparatus in accordance with the invention comprises a mould box having side walls, means defining a base wall, a tamper plate movable into the upper and open end of the mould box, and a frame including a number of elements, said elements being spaced from the tamper plate during compaction of material within the mould box.

According to a further feature of the invention the frame is mounted on the tamper plate with the elements of the frame being disposed in spaced relationship to the tamper plate.

According to a further feature of the invention the apparatus includes means operable to effect relative movement of the tamper plate and frame away from the main portion of the compacted mass of material within the mould box thereby to fracture the compacted mass along a plane including the elements of said frame.

One example of a method and apparatus in accordance with the invention will now be described with reference to the accompanying drawings, in which.

Figure 1:
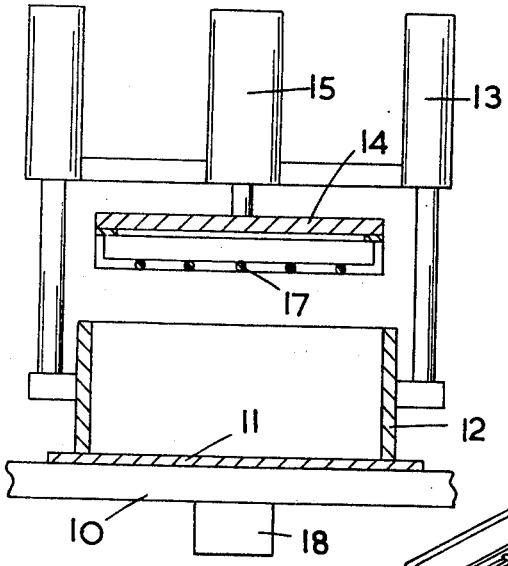
FIG. 1 shows a side elevation of an apparatus for forming building elements.

The drawings show an apparatus for producing a building element of the kind known as a wall block. Such blocks are used when building ornamental walls or when providing a facing to a wall such for instance as a concrete retaining wall. It is known to produce such blocks as described earlier, using a die. The resulting building blocks have lines formed on them which give the impression that each block comprises a number of smaller blocks and a wall constructed of such building blocks will if the lines are positioned correctly, give the initial impression of being constructed from small blocks. Each wall block will however be identical with identical contours between the lines and as a result of this, patterns will be created in the finished wall which will betray the fact that the wall is in fact constructed from a number of large wall blocks rather than smaller individual blocks of natural stone. The same sort of patterning can be obtained with for instance paving slabs or decorative panels.

The apparatus shown in the drawings is for the construction of wall blocks having an approximate size of 40 cm length, 20 cm width and 10 cm thickness. It will be understood, however, that the apparatus can be modified to provide wall blocks and building elements of differing dimensions.

The apparatus comprises a support structure part of which comprises a flat horizontal bed shown at 10 and upon which can be placed a base board 11 which defines the lower wall of a mould box. The base board 11 as its name implies, may be formed from wood. The side walls 12 of the mould box define a mould cavity the dimensions of which are chosen in accordance with the width and length of the building element it is desired to produce. The side walls are conveniently constructed from steel or cast iron and the resulting unit is movable relative to the bed 10 in an upwards direction. For this purpose the apparatus includes a pair of jacks 13 mounted on the support structure. The jacks may be operated in any convenient manner and preferably guides are provided to ensure smooth upward movement of the side wall unit.

The apparatus also includes a tamper plate 14 having a size so that it can enter into the mould cavity and it is mounted on a slider not shown, carried by the support structure. There is also provided force exerting means 15 such for instance as an hydraulic piston cylinder combination.

Figure 5:
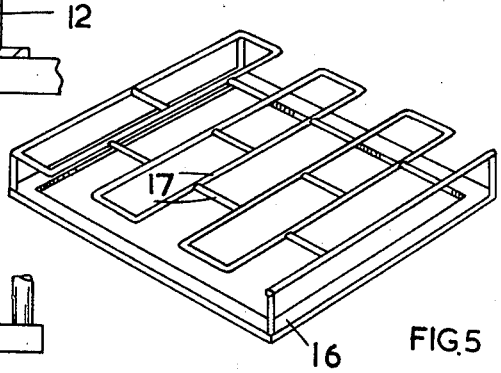
FIG. 5 is a perspective inverted view of a frame forming part of the apparatus.

The tamper plate 14 in the present example mounts a frame 16 which is shown in greater detail in FIG. 5. The frame is formed from steel or like strip which is apertured whereby it can be secured to the under surface of the tamper plate 14. Attached to the frame 16 are a plurality of elements 17 and these are conveniently of round section and lie in a plane which is substantially parallel to but spaced from the lower surface of the tamper plate. The elements are positioned to correspond with the desired pattern of lines on the finished wall block. In the example of FIG. 5 the elements are positioned so that the resulting wall block will have the appearance of a number of smaller blocks.

Figure 2:
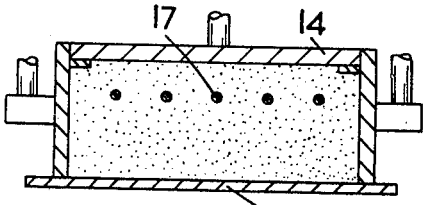
FIGS. 2, 3 and 4 show the various stages of production.
Figure 3:
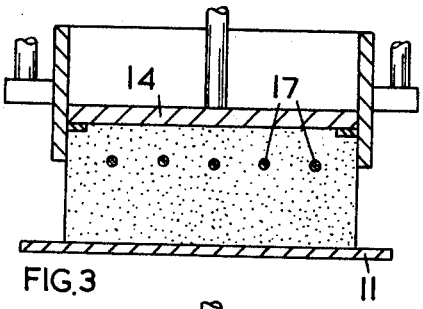
Figure 4:
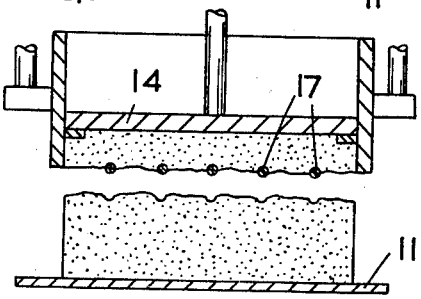

In operation, with the parts of the apparatus in the positions shown in FIG. 1 a semi-dry mix of material from which the wall block is to be formed, is placed in the mould cavity. In one example the material comprises a cement, sand, stone fines mixture and the amount of material placed in the cavity may be automatically controlled. With the material in the mould cavity the tamper plate 14 is lowered into the cavity by energising the force exerting means 15 and compaction of the mixture occurs such compaction being assisted by the action of vibrator means 18 mounted on the apparatus and adapted when in operation, to vibrate the mould. When the required degree of compaction has been attained the parts constituting the mould box assume the position shown in FIG. 2. The side wall unit of the mould box is then moved upwardly as shown in FIG. 3 and during this movement the tamper plate is held against movement. The effect of moving the wall unit upwardly is to eject the compacted mass, the tamper plate acting as an ejector.

Ejection of the compacted mass continues until the lower edges of the wall unit are substantially level with the elements 17 of the frame. At this point the tamper plate is also moved upwardly and the effect of this is to cause fracture of the compacted mass along the plane occupied by the elements 17. The mass remaining on the base board 11 is allowed to cure and forms the wall block.

The fractured face of the compacted mass forms the front face of the finished wall block, and the face bears lines in the form of grooves having a generally semi-circular section. Moreover, the front face of the wall block intermediate the grooves has a random split appearance and in general no two blocks produced on the apparatus will have the same surface contour and appearance. A wall constructed of such wall blocks will not therefore exhibit the patterning effects described to such an extent as occurs with wall blocks constructed using a preshaped die.

It will be appreciated that when the tamper plate 14 is moved into the mould cavity the elements 17 are pressed into the mass of material in the mould cavity. Moveover, since compaction takes place whilst the elements are within the material the material between the elements 17 and the face of the tamper plate is also compacted. This fact is important because it enables fracturing of the compacted mass to occur. The compacted material which is retained between the elements 17 and the face of the tamper plate is removed prior to the formation of the next block and this can be achieved by vibrating the tamper plate so that the retained material falls into the mould cavity before fresh material is loaded therein. In this case the previously compacted material is incorporated into the next block which is manufactured. If desired, however, the previously compacted material may be removed from the apparatus and utilized elsewhere.

As described the compacted mass is only partly ejected from the wall unit. It will be understood however that complete ejection can take place prior to fracturing the compacted mass.

The elements 17 are mounted on the frame 16 in accordance with the desired configuration of lines or grooves in the finished wall block. In the example illustrated the lines or grooves are positioned in a regular manner. They may however be positioned so that a specific shape is obtained in outline such for instance as a circle or square. This technique is particularly applicable to decorative panels.

Other types of commercially available moulding machine may be adapted to achieve the same results. For instance machines are produced in which blocks are laid directly upon the floor of the factory and in which the machine moves along the floor and deposits blocks at spaced intervals on the floor. In this case the support structure of the machine is modified, the base board 11 and bed 10 being omitted and being replaced by the floor of the factory. Moreover, the vibrator means 18 is positioned on the tamper plate or on the wall unit. In another known form of maching suitable for the purpose the compacted block is ejected from the mould cavity by moving the base board through the wall unit or more correctly by lowering the wall unit after compaction has taken place. In this case the base board acts as the ejector.

The concept of fracturing the block by removal of the frame can also be applied with the frame in different positions. In one arrangement the frame 16 is disposed vertically against one side wall 12 of the mould box, the elements 17 being spaced from the side wall. The mix is placed into the mould cavity and compacted using the tamper plate and then the compacted mass is removed from the mould cavity after which the frame is removed leaving the desired surface on the side of the block. In this case the mould dimensions need to be adjusted to provide a block of the required dimensions.

In another arrangement the frame 16 is placed adjacent the base board of the mould with the elements 17 extending substantially parallel thereto but spaced therefrom. A semi-dry mix is placed in the mould cavity and compacted. The compacted mass is removed from the mould and placed on one of its side faces or on what in the mould was its upper face, and the frame removed. This results in the front face of the wall block having the desired pattern and finish.

The dimensions of the building element described are such that satisfactory fracture occurs between the bars defining the elements. If the spacing of the bars is increased satisfactory fracture may not be achieved. This can be overcome by attaching to the frame at positions intermediate the bars, further elements in the form of thin rods extending at right angles to the tamper plate. The rods may be provided with small heads or they may have sharp ends and be barbed along their length. In the case where the rods are provided with heads, the size of the heads is such that no noticeable impression occurs on the finished building element.

The bars may be omitted if no lines or grooves are required on the finished building element. In this case the rods are positioned all across the frame so as to enable satisfactory fracture to take place.

In some instances the rods are of increased size and their ends are shaped so that a specific outline is obtained on the finished building element.

I claim as my invention:

1. A method of producing a plurality of cast blocks for building constructions, decorative panels and the like; each block having a substantially identical surface pattern on the face thereof to be exposed, the pattern taking the form of recessed lines impressed in said surface with the areas between said recessed lines having a random split appearance and contour, comprising successively filling a mold box having side walls and a bottom wall with a mass of semi-dry mix of the material from which the building element is to be formed, embedding the same frame in the material, the frame including a number of rigid interspaced elements, the center lines of which lie in a plane spaced from said bottom wall; compacting the mass of material with the elements of said frame embedded in the compacted mass so that a portion of the mass lies above said elements of the frame and a portion of the mass lies below said elements of the frame; then moving the frame and its elements relative to that compacted mass so as to randomly fracture the compacted mass in the space between said elements substantially along said plane, and removing the frame together with the portion of the compacted mass located above said elements of the frame to produce a pattern on each cast block wherein the fractured surface between said elements forms said areas having the random split appearance that is positioned between the impressed recessed lines forming said surface pattern on said exposed face of each of the cast blocks.

2. A method as claimed in claim 1 including the step of partly ejecting the compacted mass from the mold prior to moving the frame to fracture the compacted mass.

3. A method as claimed in claim 1 including the step of completely removing the compacted mass from the mold prior to moving the frame to fracture the compacted mass.

4. A method as claimed in claim 1 in which compaction of the mass is achieved by applying pressure to the material.

* * * * *

UNITED STATES PATENT OFFICE

CERTIFICATE OF CORRECTION

Patent No. 3,981,953 Dated SEPTEMBER 21, 1976

Inventor(s) DONALD JOHN HAINES

It is certified that error appears in the above-identified patent and that said Letters Patent are hereby corrected as shown below:

Under the title "Foreign Application Priority Data"

U. K. 16801/73 filing date should be April 7, 1973.

Signed and Sealed this

Eighth Day of February 1977

[SEAL]

*Attest:*

RUTH C. MASON
*Attesting Officer*

C. MARSHALL DANN
*Commissioner of Patents and Trademarks*